US005561685A

United States Patent [19]

Lehr et al.

[11] Patent Number: 5,561,685

[45] Date of Patent: Oct. 1, 1996

[54] MODULAR SPRAY COOLED SIDE-WALL FOR ELECTRIC ARC FURNACES

[75] Inventors: David A. Lehr, Medina; Gordon R. Roberts; Frank H. Miner, both of North Olmstead; William H. Burwell, Olmstead Falls; Mark T. Arthur, Lakewood, all of Ohio

[73] Assignee: UCAR Carbon Technology Corporation, Danbury, Conn.

[21] Appl. No.: 429,923

[22] Filed: Apr. 27, 1995

[51] Int. Cl.[6] ..... F27D 1/12

[52] U.S. Cl. ..... 373/76; 373/71; 373/74

[58] Field of Search ..... 373/71, 72, 75, 373/74, 76

[56] References Cited

U.S. PATENT DOCUMENTS

| | | | |
|---|---|---|---|
| 4,091,228 | 5/1978 | Brown et al. | 373/76 |
| 4,410,999 | 10/1983 | Wabersich et al. | 373/76 |
| 4,637,034 | 1/1987 | Grageda | 373/76 |
| 4,715,042 | 12/1987 | Heggart et al. | 373/74 |
| 4,815,096 | 3/1989 | Burwell | 373/74 |
| 4,849,987 | 7/1989 | Miner et al. | 373/74 |
| 5,327,453 | 7/1994 | Arthur et al. | 373/74 |

*Primary Examiner*—Tu Hoang

*Attorney, Agent, or Firm*—Frederick J. McCarthy

[57] ABSTRACT

Spray cooled side-wall assembly for an electric arc furnace which includes individual spray cooled segments joined together to form a furnace side-wall. One or more of the segments can be arch-shaped and surround a spray cooled sub-assembly to address conditions of high thermal stress.

3 Claims, 5 Drawing Sheets

MODULAR SPRAY COOLED SIDE-WALL FOR ELECTRIC ARC FURNACES

FIELD OF THE INVENTION

This invention relates to spray cooled furnace side-wall segments for an electric arc furnace. In a particular embodiment, the invention relates to a spray cooled sub-assembly which fits within a side-wall segment at a location subject to very high thermal stress, i.e. high temperatures.

BACKGROUND OF THE INVENTION

Spray cooled electric furnace systems of the type disclosed in U.S. Pat. No. 4,715,042, 4,815,096 and 4,849,987 involve the spray cooling of furnace closure elements, e.g. roofs and side walls, which are unitary, i.e. formed into one piece. Due to the geometry of furnace electrodes and oxygen lances and the like, variations in heating of the furnace, occur and a particular relatively discrete region of the surface of a spray cooled closure element, e.g. a side wall, can be exposed to unusually high temperature and become thermally stressed with the risk of failure at such region. U.S. Pat. No. 5,327,453 describes a steel frame and copper plate assembly for use with unitary furnace closure elements to address locations of high thermal stress.

Since the furnace systems as above described have unitary, one-piece, carbon steel closure elements, it is not possible to use replaceable, removable customized sections to address the situation.

SUMMARY OF THE INVENTION

A side-wall assembly is provided for an electric arc furnace which includes a plurality of closely adjacent hollow-spray cooled segments which are detachably interconnected and which can include separate sub-assemblies to address locations of particularly high thermal stress.

DETAILED DESCRIPTION OF THE INVENTION

Figure 1:
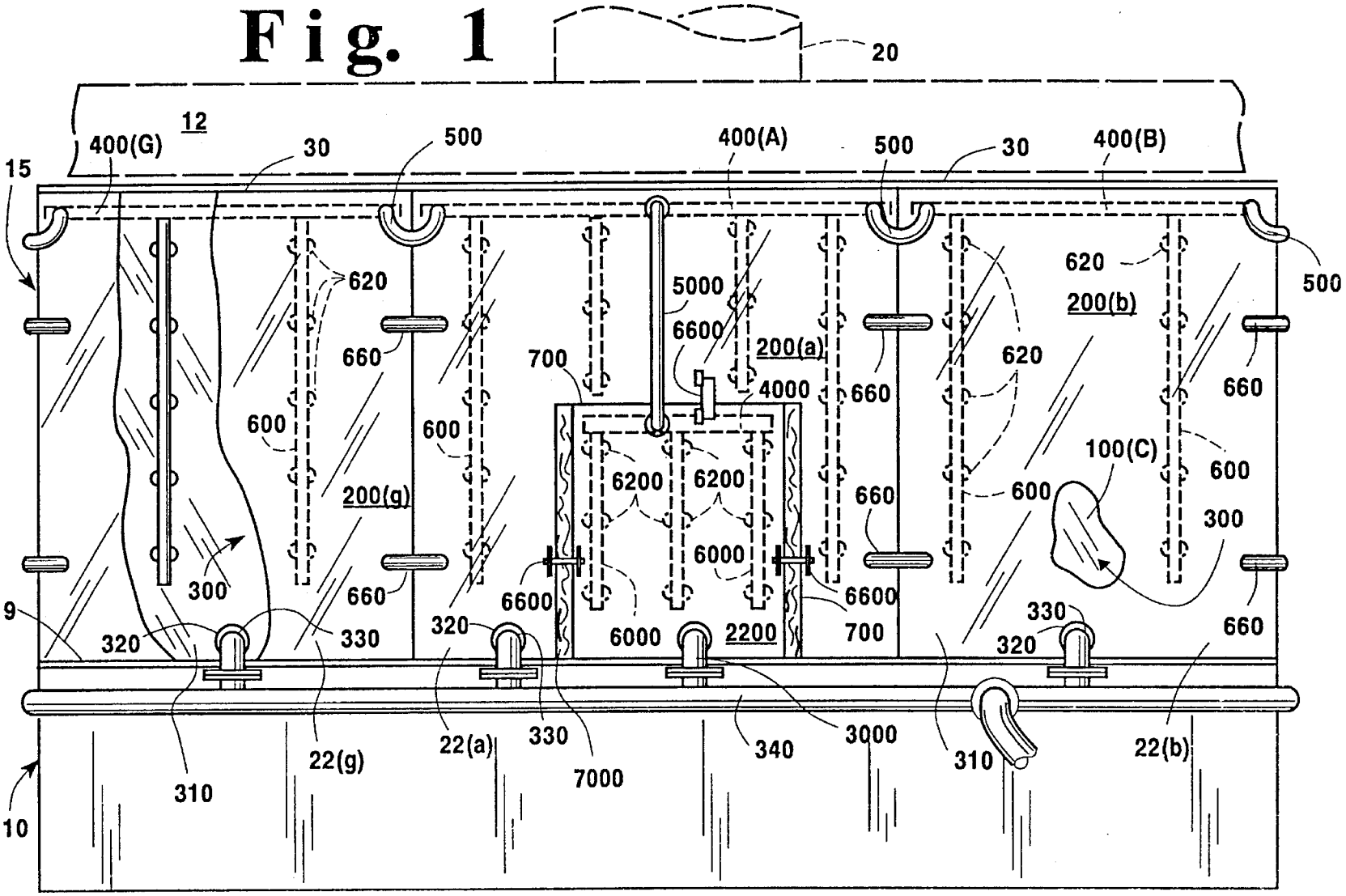
FIG. 1 is an elevation view of a side-wall assembly in accordance with the present invention.
Figure 2:
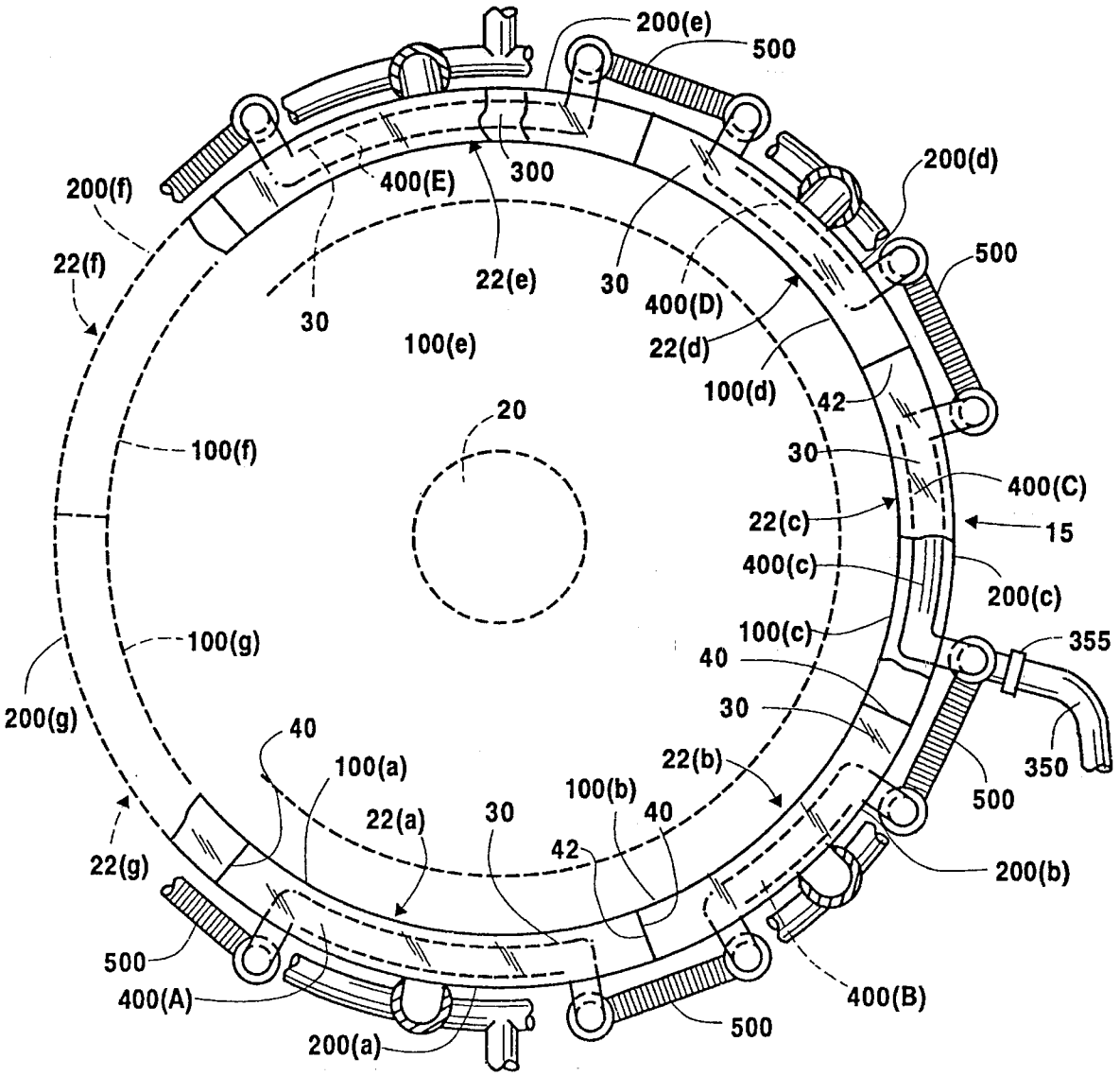
FIG. 2 is a top plan view of a side-wall assembly in accordance with the present invention.
Figure 3:
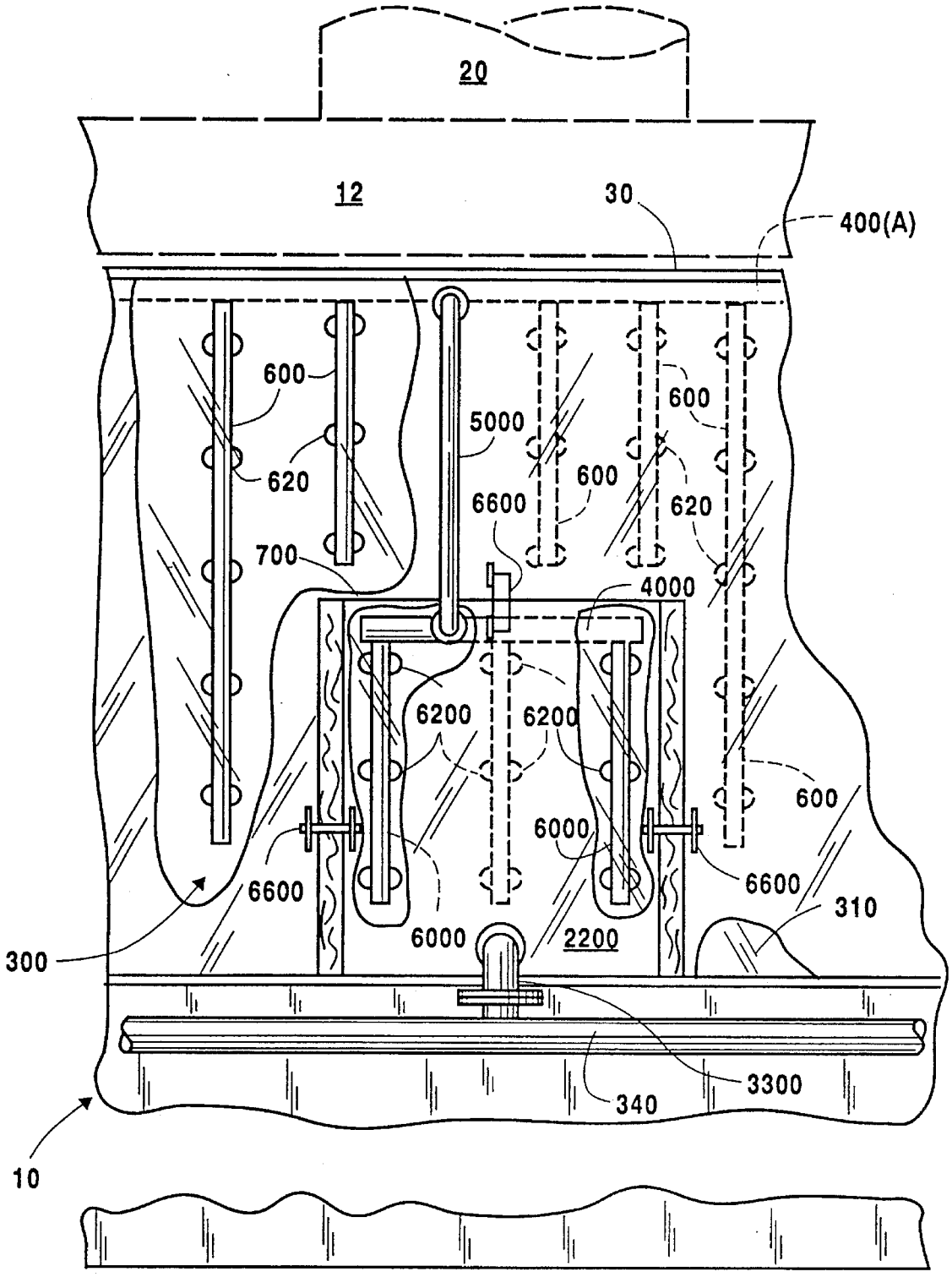
FIG. 3 is an elevation view showing a spray cooled sub-assembly in accordance with the present invention.
Figure 4:
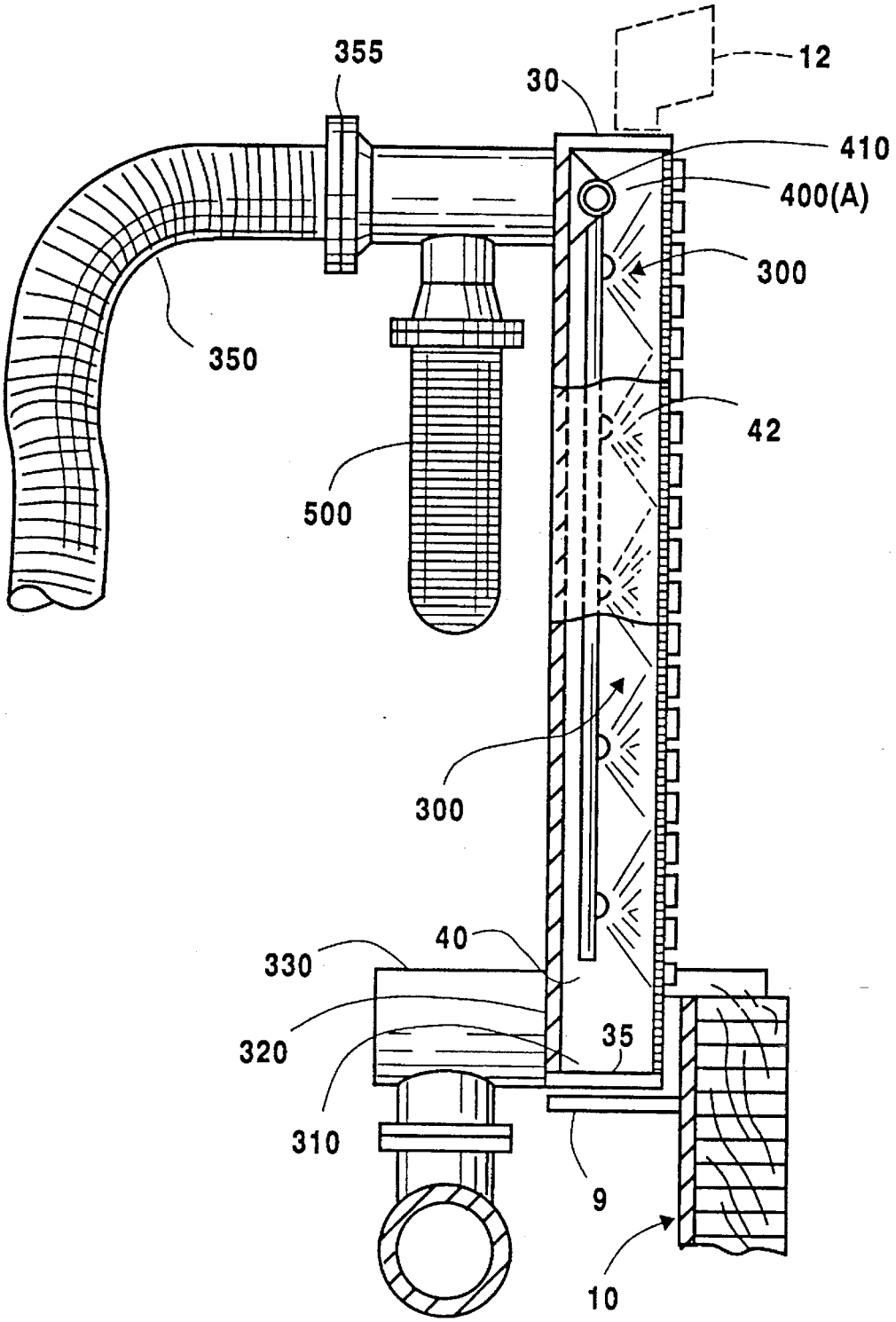
FIG. 4 is a side elevation view partly in section of a segment of a side-wall assembly in accordance with the present invention.
Figure 5:
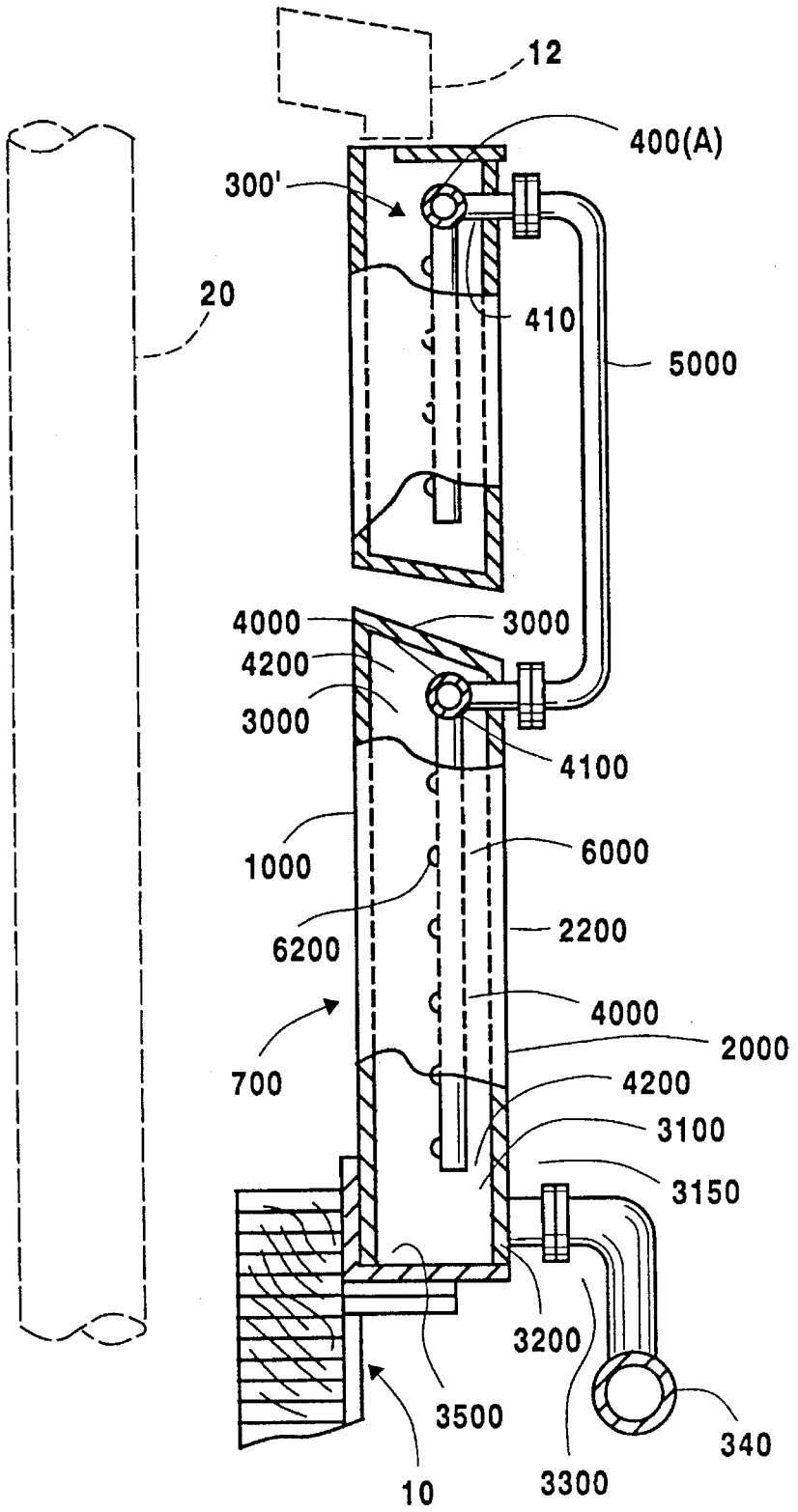
FIG. 5 is a side elevation view partly in section of a spray cooled sub-assembly in accordance with the present invention.

With reference to FIG. 1, an electric arc furnace vessel is indicated at 10, having a roof schematically illustrated at 12, and a side-wall assembly shown at 15 which surrounds electrode 20. Peripheral hollow side-wall segments 22(*a*)–(*g*), shown also in the top, plan view of FIG. 2, are arranged in a side-by-side, i.e. lateral, abutting relationship, and are supported on flange 9 of arc furnace vessel 10. Each of the hollow side-wall segments 22(*a*)–(*g*) , with reference to FIGS. 1 and 2, has respective inner metal base members 100(*a*)–(*g*) shaped to form a predetermined portion of the side-wall assembly. Outer metal covering members

200(*a*)–(*g*) are spaced from and respectively in register with the inner metal base members 100(*a*)–(*g*) . With reference to FIGS. 1–4, a substantially enclosed space 300 is established for each side-wall segment 22(*a*)–(*g*) by metal top plate 30, metal bottom plate 35, and metal side plates 40, 42, which join the outer covering members 200(*a*)–(*g*) to the inner base members 100(*a*)–(*g*). At the lowermost portion 310 of each enclosed space 300 a drain opening 320 is provided which communicates with drain outlet 330 and peripheral coolant drain conduit 340 adjacently exterior of and peripheral to the side-wall segments 22(*a*)–(*g*). Liquid coolant supply conduit 350 is removably connected at 355 to one of the horizontally extending liquid coolant supply header conduits 400(*a*)–(*g*) mounted at 410 within the respective hollow segments 22(*a*)–(*g*). A plurality of detachable conduits 500 are provided exterior the hollow side-wall segments for connecting, in tandem, the respective liquid coolant supply header conduit 400 in each of the hollow segments 22(*a*)–(*g*).

In operation, liquid coolant e.g. water, is delivered under pressure from coolant supply conduit 350 to one of the liquid supply header conduits 400; this particular header conduit being designated as 400(A). A plurality of hollow spray bars 600 extend transverse to and downwardly from header conduit 400(A) within hollow-segment 22(*b*) to deliver coolant to spray nozzles 620 which are selected to deliver liquid droplets to the inner metal base member 100(C) at a rate which cools the inner base member 100(C) to a desired lower temperature, with the coolant remaining in liquid form and exiting enclosed space 300 through drain opening 320 and passing through drain outlet 330 to coolant drain conduit 340. Coolant under pressure from coolant supply conduit 350 passes from header conduit 400(A) to each of the other header conduits 400(*b*)–(*g*) in the respective hollow segments 22(*a*)–(*g*) by way of detachable conduits 500 which connect the header conduits 400 in tandem to deliver coolant to the hollow spray bars 600 and nozzles 620 in the respective hollow side-wall segments 22(*a*)–(*g*). The hollow side-wall segments 22(*a*)–(*g*) are adjacently engaged by removable fastening means 660 which can be welded clamp elements. The spray bar and nozzle configuration can be varied in each segment to accommodate the thermal stress conditions to which the segment is exposed.

In a particular embodiment of the present invention, when a particular location of the furnace side-wall is subject to particularly severe thermal stress, the side-wall segment at that location, e.g. side-wall segment 22(*a*), is formed in the shape of an arch with an arch opening 700, within which a removable sub-assembly 2200 is positioned. Sub-assembly 2200 is generally similar in construction to the afore-described side-wall segments and is supported on flange 9 of furnace vessel 10 and has an inner metal base member 1000 shaped to form that portion of the side-wall assembly which is subject to severe thermal stress. An outer metal covering member 2000 is provided which is spaced from and in register with inner metal base member 1000. An enclosed space 3000 is established within sub-assembly 2200 by metal top plate 3000, metal bottom plate 3500, and metal side plates 4000, 4200 which join the outer covering member 2000 to inner metal base member 1000. At the lowermost portion 3100 of enclosed space 3000 a drain opening 3200 is provided which communicate with drain outlet 3300 (removably connected at 3150) and peripheral coolant drain conduit 340. A horizontally extending liquid coolant supply header 4000, mounted at 4100 within enclosed space 3000, receives coolant under pressure from coolant supply header 400 of surrounding side-wall segment 22(*a*) by way of removably connected conduit 5000. The coolant received by coolant supply header 4000 is delivered to hollow coolant spray bars 6000 and nozzles 6200 in enclosed space 3000 which deliver liquid droplets to inner metal base member 1000 at a rate which cools the highly thermally stressed inner base member 1000 to a desired lower temperature. The number and location of the spray bars and nozzles is adjusted for the particular thermal stress conditions to which the sub-assembly is exposed. Sub-assembly 2200 is removable from the side-wall by releasing fastening elements 6600 and removing releasable conduit 5000 and drain 3300. Thus, sub-assembly 2200 is readily serviceable and repairable and is easily re-installed. Ceramic fiber insulation 7000 is suitably placed at all edges of the sub-assembly.

What is claimed is:

1. Side-wall assembly for an electric arc furnace comprising:

i) a plurality of separate, adjacent hollow side-wall segments assembled in a lateral abutting relationship and supported by the furnace to form at least a portion of a side-wall for surrounding at least one graphite electrode extending downwardly into the electric furnace, each of said hollow side-wall segments having a) an inner metal base member shaped to form a pre-determined portion of the side-wall assembly;

b) an outer metal covering member spaced from and in register with said inner metal base member;

c) means for joining the outer metal covering member to the inner metal base member and for defining a substantially enclosed space between said inner metal base member and said metal covering member, said substantially enclosed space having a lower most portion with at least one outer liquid drain opening being located at the lowermost portion of the enclosed space;

d) a plurality of spray means located within said enclosed space at predetermined locations adjacent to and spaced from said inner metal base member for directing a spray of liquid coolant in the form of liquid droplets against the inner metal base member in an amount sufficient to maintain an acceptable temperature in said inner metal base member;

e) a liquid coolant supply header conduit affixed within said enclosed space and extending across the inner metal base member for supplying liquid coolant to said spray means;

f) at least one liquid coolant drain outlet means in communication with said at least one drain opening for receiving a flow of liquid coolant from inside of said enclosed space;

ii) a liquid coolant supply conduit for supplying liquid to a liquid coolant supply header of one of the side-wall segments;

iii) a plurality of detachable conduits exterior said side-wall segments for connecting in tandem the liquid coolant supply header conduits of the plurality of separate side-wall segments;

iv) means for removably closely engaging each side-wall segment with each adjacent side-wall segment; and v) a liquid coolant drain conduit exterior said side-wall segments and adjacent the liquid coolant drain outlet means for withdrawing liquid coolant from the side-wall segments.

2. Side-wall assembly in accordance with claim 1 wherein a selected side-wall segment has an inner metal base member and an outer covering metal member in the shape of an arch to define arch-shaped side-wall segment and a sub-assembly is provided which is closely enclosed by said arch and supported by the furnace, said sub-assembly comprising:

a) a sub-assembly inner metal base member shaped to form a predetermined portion of the periphery of the side-wall assembly defined by said arch;

b) a sub-assembly outer metal covering member spaced from and in register with said sub-assembly inner metal base member;

c) means for joining the sub-assembly outer covering member to the sub-assembly inner metal base member and for defining a substantially enclosed space in said sub-assembly between said spaced apart base member and said covering member of said sub-assembly with at least one outer liquid drain opening being located at the lowermost portion of the enclosed space of said sub-assembly;

d) a plurality of spray means located within said enclosed space in said sub-assembly at predetermined locations adjacent to and spaced from said inner metal base member of said sub-assembly for directing a spray of liquid coolant in the form of liquid droplets against the inner metal base member of said sub-assembly in an amount sufficient to maintain an acceptable temperature in said inner metal base member of said sub-assembly;

e) a liquid coolant supply header conduit affixed within said enclosed space of said sub-assembly and extending across the inner metal base member of said sub-assembly for supplying liquid coolant to said spray means located in the enclosed space of said sub-assembly;

f) a detachable conduit connecting said liquid coolant supply header of said sub-assembly with the liquid coolant supply header of said selected side-wall segment;

g) at least one coolant drain outlet located adjacently outside of said enclosed space of said sub-assembly and in communication with said at least one drain opening of said sub-assembly for receiving a flow of liquid coolant from inside of said enclosed space of said sub-assembly and communicating with said liquid coolant drain conduit for withdrawing liquid coolant from said sub-assembly and substantially avoiding any buildup of liquid coolant within said enclosed space of said sub-assembly; and h) means for removably closely engaging said sub-assembly within said arch of said selected side-wall segment.

3. Side-wall assembly for an electric arc furnace comprising:

i) a plurality of separate, adjacent hollow side-wall segments assembled in a lateral abutting relationship and supported by the furnace to format least a portion of a side-wall for surrounding at least one graphite electrode extending downwardly into the electric furnace, each of said hollow side-wall segments having a) an inner metal base member shaped to form a pre-determined portion of the side-wall assembly;

b) an outer metal covering member spaced from and in register with said inner metal base member;

c) means for joining the outer metal covering member to the inner metal base member and for defining a substantially enclosed space between said inner metal base member and said metal covering member, said substantially enclosed space having a lower most portion with at least one outer liquid drain opening being located at the lowermost portion of the enclosed space;

d) a plurality of spray means located within said enclosed space at predetermined locations adjacent to and spaced from said inner metal base member for directing a spray of liquid coolant in the form of liquid droplets against the inner metal base member in an amount sufficient to maintain an acceptable temperature in said inner metal base member;

e) a liquid coolant supply header conduit affixed within said enclosed space and extending across the inner metal base member for supplying liquid coolant to said spray means;

f) at least one liquid coolant drain outlet means in communication with said at least one drain opening for receiving a flow of liquid coolant from inside of said enclosed space;

ii) a liquid coolant supply conduit for supplying liquid to a liquid coolant supply header of one of the side-wall segments;

iii) a plurality of detachable conduits exterior said side-wall segments for connecting in tandem the liquid coolant supply header conduits of the plurality of separate side-wall segments;

iv) means for removably closely engaging each side-wall segment with each adjacent side-wall segment;

v) a liquid coolant drain conduit exterior said side-wall segments and adjacent the liquid coolant drain outlet means for withdrawing liquid coolant from the side-wall segments;

vi) a selected side-wall segment being configured to have an inner metal base member and an outer covering metal member in the shape of an arch to define arch-shaped side-wall segment and having a sub-assembly which is closely enclosed by said arch and supported by the furnace and which said sub-assembly comprises:

a) a sub-assembly inner metal base member shaped to form a predetermined portion of the periphery of the side-wall assembly defined by said arch;

b) a sub-assembly outer metal covering member spaced from and in register with said sub-assembly inner metal base member;

c) means for joining the sub-assembly outer covering member to the sub-assembly inner metal base member and for defining a substantially enclosed space in said sub-assembly between said spaced apart base member and said covering member of said sub-assembly with at least one outer liquid drain opening being located at the lowermost portion of the enclosed space of said sub-assembly;

d) a plurality of spray means located within said enclosed space in said sub-assembly at predetermined locations adjacent to and spaced from said inner metal base member of said sub-assembly for directing a spray of liquid coolant in the form of liquid droplets against the inner metal base member of said sub-assembly in an amount sufficient to maintain an acceptable temperature in said inner metal base member of said sub-assembly;

e) a liquid coolant supply header conduit affixed within said enclosed space of said sub-assembly and extending across the inner metal base member of said sub-assembly for supplying liquid coolant to said spray means located in the enclosed space of said sub-assembly;

f) a detachable conduit connecting said liquid coolant supply header of said sub-assembly with the liquid coolant supply header of said selected side-wall segment;

g) at least one coolant drain outlet located adjacently outside of said enclosed space of said sub-assembly and in communication with said at least one drain opening of said sub-assembly for receiving a flow of liquid coolant from inside of said enclosed space of said sub-assembly and communicating with said liquid coolant drain conduit for withdrawing liquid coolant from said sub-assembly and substantially avoiding any buildup of liquid coolant within said enclosed space of said sub-assembly; and h) means for removably closely engaging said sub-assembly within said arch of said selected side-wall segment.

* * * * *